United States Patent [19]

Amalfi

[11] Patent Number: 4,774,789

[45] Date of Patent: Oct. 4, 1988

[54] CORNER SANDER

[76] Inventor: Jerome L. Amalfi, 956 Hope St. - Apt. 4H, Stamford, Conn. 06907

[21] Appl. No.: 96,005

[22] Filed: Sep. 14, 1987

[51] Int. Cl.[4] ..... B24B 23/04

[52] U.S. Cl. ..... 51/170 TL; 51/393

[58] Field of Search ..... 51/170 T, 170 TL, 204, 51/358, 390, 391, 392, DIG. 14, 393; 76/82, 83, 86; 29/76 A, 80

[56] References Cited

U.S. PATENT DOCUMENTS

| | | | |
|---|---|---|---|
| 1,017,237 | 2/1912 | Van Sickel | 51/170 TL |
| 2,546,245 | 3/1951 | Weigel | 51/393 |
| 3,330,537 | 7/1967 | Wason | 51/170 R |
| 3,762,046 | 10/1973 | Kolomick | 29/80 |

*Primary Examiner*—Roscoe V. Parker

*Attorney, Agent, or Firm*—Edward R. Hyde

[57] ABSTRACT

A reciprocating sanding device having a sanding shoe of two angled plates. The plates form an internal angle in order to sand or abrade an external angle.

4 Claims, 3 Drawing Sheets

CORNER SANDER

BACKGROUND OF THE INVENTION

The present invention relates to a sanding or abrading device for sanding external corners.

In the construction of thermal walls and other structures it is often necessary to have a true straight right angle. Thus, in the construction of thermal walls, a material such as sheets of expanded polystyrene boards are applied to an underwall or substrate which for example may be plywood. A mesh and cement is applied to the outer surface of the polystyrene boards. In such construction, it is important that the polystyrene boards be flat and the corners straight and even. This conventionally requires sanding of the boards by means of abrading or sanding devices because in the absence of sanding the boards are not usually sufficiently even level and with a true smooth finish. The present invention is directed toward a device for sanding the outer or external corner where two polystyrene boards are joined at a right angle. The sander of the present invention serves to provide a straight, true ninety degree corner.

SUMMARY OF THE INVENTION

The device of the present invention comtemplates a sanding shoe comprising two flat plates disposed at a right angle to provide sanding surfaces for sanding an external angle. The sanding shoe has a suitable mounting bracket to secure the shoe to a motor unit in a convenient manner for reciprocating the sanding shoe.

Accordingly, it is the primary object of the present invention to provide a sanding device suitable for conveniently sanding an external corner in order to provide a true, straight corner edge.

Another object of the present invention is to provide a sanding or abrading device that is of simple and convenient construction for sanding outside or external corners.

A still further object of the present invention is to provide a external right angle sanding device having two perpendicular sanding surfaces for sanding or abrading the corner of walls in order to provide a straight, true right angle corner.

DETAILED DESCRIPTION OF THE INVENTION

Figure 1:
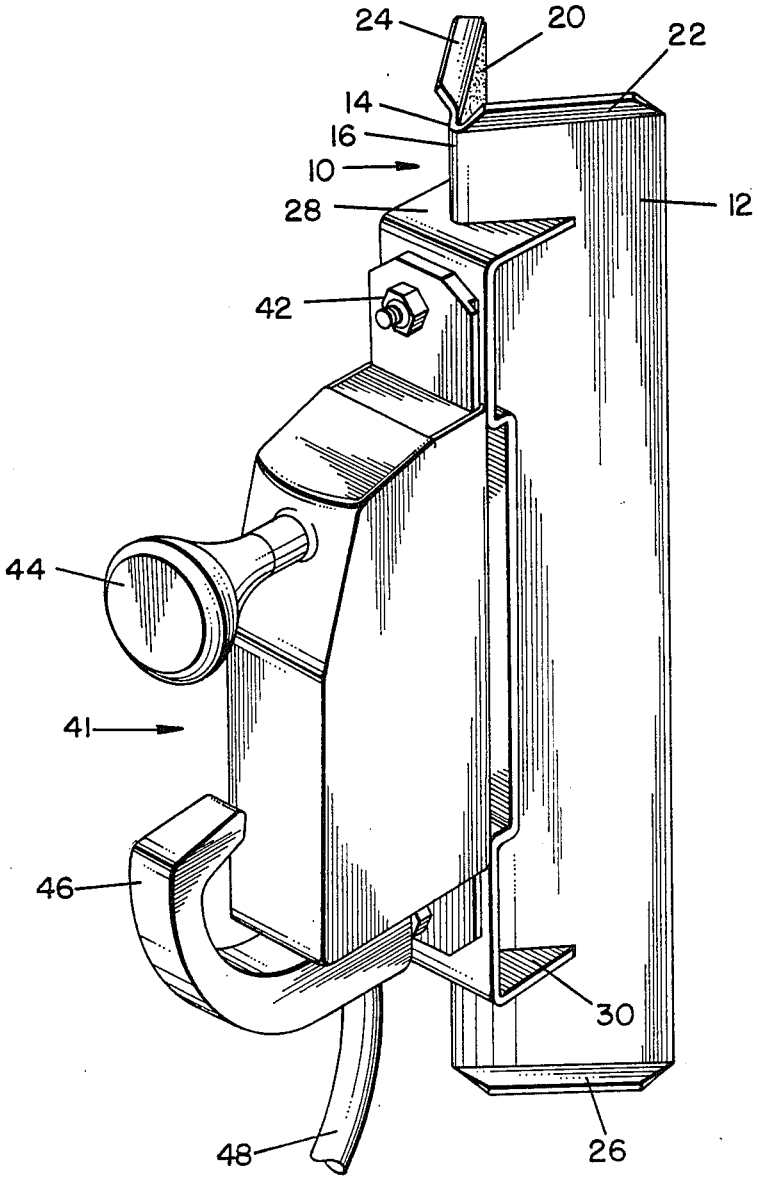
FIG. 1 is a perspective view of a corner sander of the present invention.

Referring now to the drawings and more particularly to FIG. 1, numeral 10 indicates a sanding shoe having two plates 12 and 14 disposed at right angles. The plates may be made of any convenient rigid sheet material such as stainless steel or alternatively an aluminium alloy. The two plates are joined together as at edge 16 and could be made intergal as shown in the drawings.

The inner surfaces of plates 12 and 14 have secured thereto an abrading or sanding material 18 and 20 which may be cemented to the plates or secured in any other convenient manner. The plates 12 and 14 terminate at one end with flared edges 22, 24 and similar flared edges 26 and 28 at the other end. The purpose of the flared edges is to permit the sander to slide smoothly over the corner being sanded without any possibility of digging into the corner walls.

A U-shaped mounting bracket 27 has arms 28, 30 with 90 degree cutouts so that the mounting bracket will fit over the corner edge 16 of the sanding shoe. The mounting bracket is firmly secured to the sanding shoe plates as by welding along the cutout portions of arms 28, 30. The portion 32 of the mounting brackets rests along the edge 16 of the sanding shoe and may be welded thereto in order to provide a firm bond between the sanding shoe 10 and mounting bracket 27. The outer ends of arm 32 are bent upwardly as at 34 and 36 and has slotted openings 38 and 40 to receive mounting bolts as 42.

Motor power may be conveniently supplied by a commercially available pneumatic air motor 41. The later is an air compressor cylinder-piston type mechanism of known construction and may have a knob handle as 44 and a pistol grip 46. Air pressure is supplied through a suitable tube 48. The motor unit 42 is secured to the sanding shoe bracket by two mounting bolts 42. Although a pneumatic motor unit is described and disclosed in the drawings it is understood that an electric motor or other type may be employed. Also, for some applications the sander would be used manually and an appropriate handle would be secured to the mounting bracket in the place of the motor unit.

Figure 2:
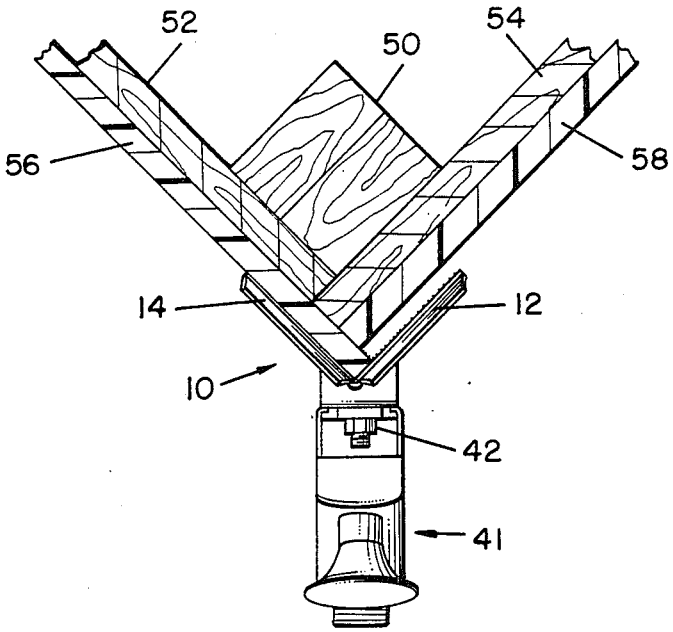
FIG. 2 is a top view of the sander in operation against a corner structure.
Figure 3:
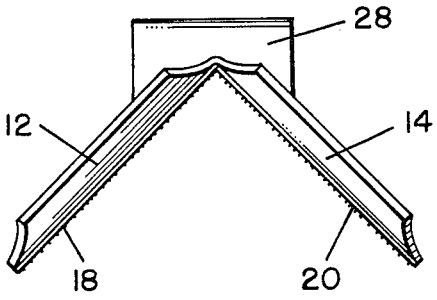
FIG. 3 is a front end view of the sander.
Figure 4:
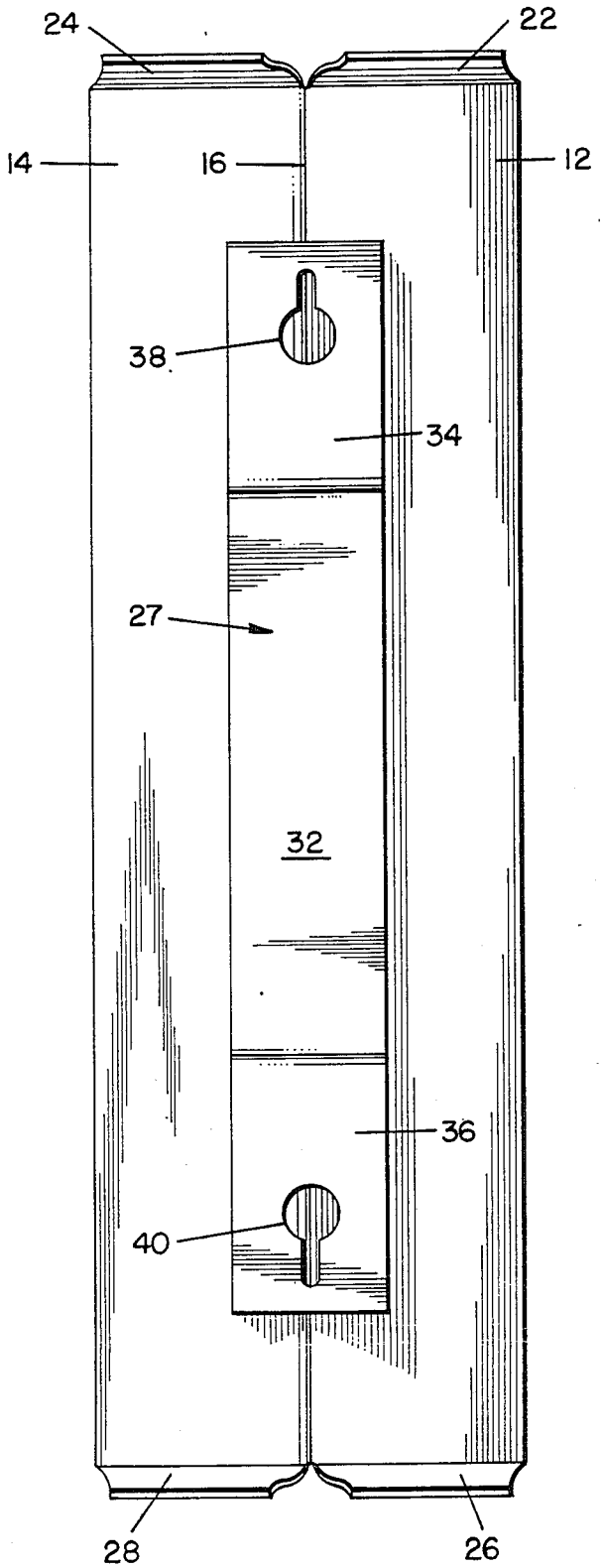
FIG. 4 is a top view of the sanding shoe and mounting bracket.
Figure 5:
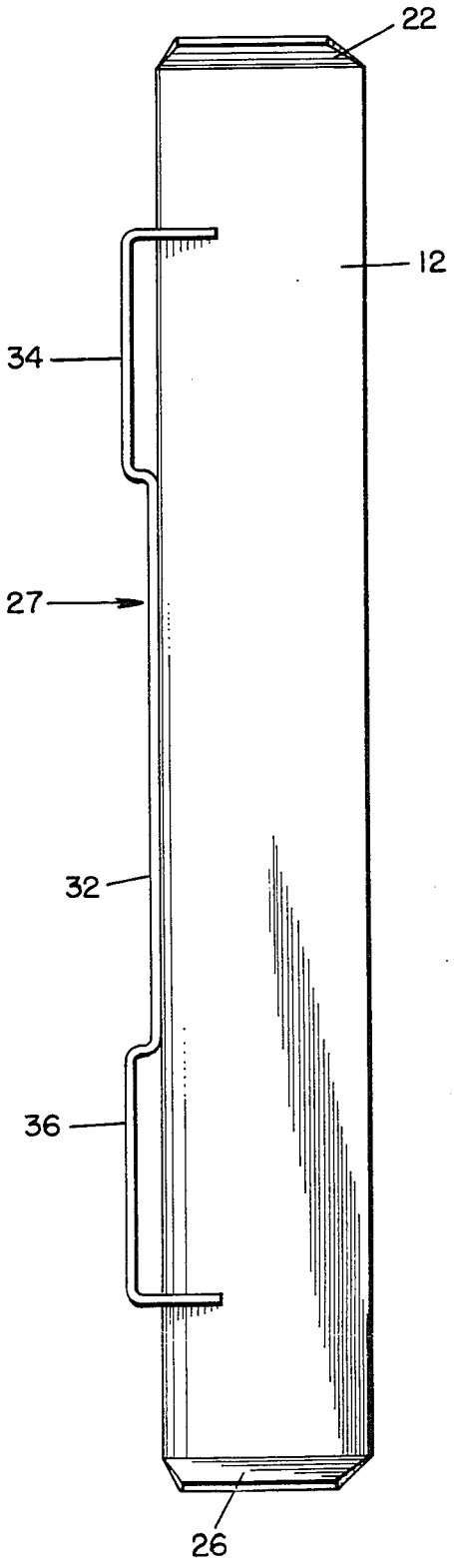
FIG. 5 is a side view of the unit of FIG. 4.

Referring now to FIG. 2 there is shown a wall assembly comprising a beam or studs 50 supporting an underwall such ( as sheets of plywood 52 and 54. The polystyrene boards 56 and 58 are secured to the siding and as seen in FIG. 2 come together at a 90 degree corner with board 56 extending slightly beyond 58. The sanding unit of the present invention is in position to sand the corner where 56, 58 join as shown in the drawing would proceed to sand down the end of polystyrene board 56 until it is flush with the outer surface of 58 to provide a smooth, straight and true corner. The reciprocating sander will be manually held and moved up and down the outer corner of the polystyrene boards. In some instances it might only be necessary to have an abrading or sanding surface on only one of the two sanding plates. FIG. 2 illustrates such a situation in which it would only be necessary to have the abrading surface against plate 12 in order to sand the edge of board 56. Thus, the present invention can be used with abrading material on either one or both of the internal surfaces of sanding plates 12 and 14.

Although the present invention has been disclosed in respect to a specific embodiment thereof, it is understood that various modifications may be made without departing from the spirit and scope of the invention as set forth in the appended claims.

I claim:

1. A sander for sanding the external surfaces of a corner structure comprising;

a sanding shoe;

said sanding shoe having two flat elongated plate members;

said plate members being disposed to form an internal angle to each other of substantially ninety degrees;

abrading means secured to the internal angled surface of at least one of said plate members;

the outer end edges of each elongated plate being flared outwardly;

a U-Shaped mounting bracket secured to said sanding shoe; and power means providing reciprocating motion secured to said mounting bracket to impart reciprocating motion to said sanding shoe whereby movement of the sanding shoe along the external right angled surfaces of a corner structure will abrade the said surfaces to provide a true, straight right angle.

2. A sander for sanding the external surfaces of a corner structure comprising;

a sanding shoe;

said sanding shoe having two flat elongated plate members;

said plate members being integral along a common edge and being disposed to form an internal angle to each other of substantially ninety degrees;

abrading means secured to the internal angled surfaces of said plate members;

the outer end edges of each elongated plate being flared outwardly;

a U-Shaped mounting bracket secured to said sanding shoe along said common edge;

power means providing reciprocating motion secured to said mounting bracket to impart reciprocating motion to said sanding shoe whereby movement of the sanding shoe along the external right angled surfaces of a corner structure will abrade the said surfaces to provide a true, straight right angle.

3. A sander as set forth in claim 2 in which the base of said U-Shaped mounting bracket has two offset end sections that extend away from the said common edge to permit mounting of the power means to said bracket.

4. A sander for sanding the external surfaces of a corner structure comprising:

a sanding shoe;:

said sanding shoe having two flat elongated plate members;

said plate members being disposed to form an internal angle to each other of substantially ninety degrees;

abrading means secured to the internal angled surface of each said plate members;

the two outer end edges of each elongated plate member being flared outwardly;

a mounting bracket secured to said sanding shoe; and power means providing reciprocating motion secured to said mounting bracket to impart reciprocating motion to said sanding shoe whereby movement of the sanding shoe along the external right angled surfaces of a corner structure will abrade the said surfaces to provide a true, straight right angle.

* * * * *